United States Patent [19]

Ugaji et al.

[11] Patent Number: 4,726,443

[45] Date of Patent: Feb. 23, 1988

[54] DIAPHRAGM

[75] Inventors: Masana Ugaji, Tokyo; Shinichi Watanabe, Chiba; Hiroyuki Sogawa; Nobuo Fuke, both of Kanagawa; Masatsugu Maejima, Tokyo; Koichi Saruwatari, Tokyo, all of Japan

[73] Assignee: Sony Corporation and Fujikura Ltd., Tokyo, Japan

[21] Appl. No.: 783,574

[22] Filed: Oct. 3, 1985

[30] Foreign Application Priority Data

Oct. 3, 1984 [JP] Japan ..... 59-207690
Oct. 3, 1984 [JP] Japan ..... 59-207691
Oct. 3, 1984 [JP] Japan ..... 59-207692

[51] Int. Cl.[4] ..... G10K 13/00; H04R 7/02

[52] U.S. Cl. ..... 181/167; 181/168; 428/315.5

[58] Field of Search ..... 181/167, 168; 428/315.5, 315.7, 315.9

[56] References Cited

U.S. PATENT DOCUMENTS 4,230,539 10/1980 Saruwatari et al. ..... 204/37.1 X
4,368,107 1/1983 Maejima et al. ..... 204/24

FOREIGN PATENT DOCUMENTS 55-11553 1/1980 Japan .
55-13198 1/1980 Japan .
55-14155 1/1980 Japan .
55-15156 2/1980 Japan .
55-35476 3/1980 Japan .
0015157 4/1980 Japan ..... 181/168
0015911 4/1980 Japan ..... 181/168
0097295 6/1982 Japan ..... 181/167

*Primary Examiner*—Benjamin R. Fuller
*Attorney, Agent, or Firm*—Hill, Van Santen, Steadman & Simpson

[57] ABSTRACT

A diaphragm using a metal material applied with anodic oxide films, in which said metal material contains one of lead compounds, inorganic metal compounds and phosphor compounds at least to a portion in the micropores of the anodic oxide film.

10 Claims, 3 Drawing Figures

DIAPHRAGM

BACKGROUND OF THE INVENTION

1. Field of the Invention

This invention relates to a diaphragm and, particularly, it relates to a diaphragm using metal materials.

2. Description of the Prior Art

In the case of using metal materials as a diaphragm, various countermeasures are taken for improving the acoustic characteristics thereof. Specifically, since metal materials generally have sharp resonance or lower internal loss, they produce sharp peaks near the high frequency critical point fh or peculiar colorations resulted therefrom to produce harsh sounds. This drawback can be solved to some extent by the use of vibration damping metal materials that is, vibration-damping alloys such as Al-Zn, Mg-Zr, Ti-Ni or by combining metal materials with vibration damping materials, for example, in case of an aluminum substrate, so as to make a composite vibration damping structure by coating or appending vibration damping rubber or resin such as synthetic rubber, natural rubber, foamed urethane or like other elastomer therewith. This vibration damping structure has generally been adopted under consideration not only the vibration isolation effect but also the endurance particularly, improvement in the corrosion resistivity of metal by coating or lamination and view point of the outer looking. The prior art therefor includes coating of resin such as urethane, epoxy, acryl, etc, to the surface of the metal material, and lamination of elastic films such as of olefin, amide, ionomer. However, if the amount of the vibration-damping material is increased with an aim of improving the vibration-damping effect, the thickness and thus the weight are proportionally increased thereby leading to the reduction in the sensitivity.

While on the other hand, improvement in the endurance and increase in the strength are required for metal materials used as diaphragms and, particularly, improvement in the modulus of specific elasticity or increase in the sonic velocity is demanded. However, the improvement in the mechanical strength or the increase in the elasticity is generally in contradiction with the reduction of the resonance described above and it is difficult to simultaneously satisfy both of the requests. Further, increase in the density of the material and thus in the entire weight for improving the strength causes to the reduction in the sensitivity. Although as the prior method of increasing the strength and elasticity includes deposition of metal borides, carbides, nitrides, oxides or the like to the surface of materials by means of CVD, PVD, such as sputtering, plasma welding, ion beams or the like or flame spraying of ceramics are known, they cannot be applied with ease, requiring large-scaled apparatus and highly developed technique. Further, while it has been also considered to improve the strength or the like by compositing them through lamination of different kinds of metals into a clad structure or alloying them with each other, it has not always been quite satisfactory when the relationship with the problems of the vibration-damping as described above, and increase of the weight, productivity, workability and the like are considered.

Referring, for example, to aluminum as the metal material having been used to diaphragms, although it has moderate acoustic physical properties, and the workability, endurance, productivity and cost performance thereof are satisfactory to some degree, there has been a limit for the practical use because of the low internal loss or high resonance and insufficiency in the strength. Accordingly, aluminum is not advantageous in a case where the high frequency critical point fh is intended to be extended toward a higher frequency or where it is intended to suppress the peaks at the high frequency region to thereby flatten the sensitivity.

In view of the above, reduction in the resonance sensitivity and increase in the strength as described above have highly demanded in using the aluminum as the metal material. The situations are identical also in the case of using magnesium, titanium or the like.

As described above, various methods for improving by making composite materials have been adopted in order to solve the problems of metal materials as described above. As one of the typical examples, methods which constitute a honeycomb diaphragm has been proposed. In this method the range of the reproducing frequency band is determined with $D/\sigma$, where D represents bending regidity and $\sigma$ represents surface density and, since the bending rigidity D can be increased by the honeycomb structure, the range of the reproducing frequency band can be extended. However, the bending rigidity D has to be more increased in order to further extend the range. Further, it is desired to decrease the surface density $\sigma$ by selecting the material used for the surface material. In view of the above, it is necessary to reduce the weight and increase the strength of the surface material. Furthermore, in order to suppress the generation of sharp peaks of high sharpness of resonance at higher harmonics mode in the honeycomb diaphragm, it is necessary to improve the internal loss of the surface material, that is, to reduce the resonance as described also above. In addition, reduction in the density is desired in view of the contribution to the increase in the sensitivity.

The situations are identical also in the vibration systems other than the honeycomb diaphragms, where it has been desired for the reduction of the resonance, increase in the rigidity and reduction in the density for the metal materials used for the diaphragm.

While on the other hand, there has been proposed a technique for improving the acoustic characteristics by anodizing aluminum and filling nickel or molten aluminum in the micropores of the alumina layer (refer to Japanese Patent Publications Nos. 13198/1982 and 11553/1982). However, in the proposed technique, diffusing force of filling into the micropores is weak to result in a problem in the close bondability and instability. In the case of nickel filling, a disadvantage of increased density is caused. In addition, there has been also proposed to form many fine pores in the substrate metal such as aluminum and fill the pores with those substances having large internal loss such as synthetic resin or oil (refer to Japanese Patent Publication No. 15156/1980). However, the technique also has a problem in the stability and can not be applied with ease to those materials having micropores such as anidic oxide film. There is also a problem of degradation in the filled synthetic resin or oil. In addition, the density becomes excessively great.

OBJECTS AND SUMMARY OF THE INVENTION

This invention has been made in view of the foregoing situations and the object thereof is to provide a diagphram in which the sharpness of resonance of a metal material used can be reduced that is, the internal loss is increased.

Another object of this invention is to provide a diaphragm im which the bending rigidity can be increased.

A further object of this invention is to provide a diaphragm capable of preventing the occurrence of peaks at a higher frequency region.

A further object of this invention is to provide a diaphragm capable of extending the range of the reproducing frequency band.

A still further object of this invention is to provide a diaphragm capable of improving the quality of inherent sounds.

A yet further object of this invention is to provide a diaphragm capable of obtaining uniformly and conveniently at a reduced cost without increasing the density, increasing the weight or reducing the sensitivity.

The foregoing objects can be attained in accordance with this invention in a diaphragm using a metal material applied with anodic oxide film, in which the metal material contains either one of lead compounds, inorganic metal compounds and phosphor compounds formed at least to a portion in the micropores of the anodic oxide film.

The foregoing and other objects, features and advantages of this invention will become apparent by the following descriptions made in conjunction with the appended drawings.

DESCRIPTION OF THE PREFERRED EMBODIMENTS

Figure 1:
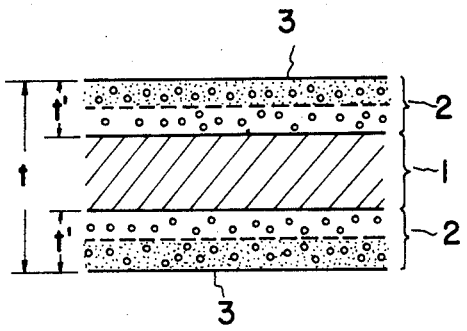
FIG. 1 is a cross sectional side elevational view showing a diaphragm according to one embodiment of this invention.

The diaphragm according to this invention will now be described more specifically.

The metal materials used for the diaphragm in this invention are those metals capable of anodic oxidation and they include, for example, aluminum, magnesium, titanium and other valve metals. In practicing this invention, the metal materials can be used in the form of a foil.

In one embodiment according to this invention, a lead compound is formed at least to a portion of micropores resulted in the oxide film of the anodically oxide metal material. Lead sulfide PbS can be exemplified as the lead compound. The lead sulfide may be formed to the micropores in the anodic oxide film by the secondary electrolysis or alternating immersion method. In the secondary electrolysis process, a metal material applied with an oxide film through the primary anodic oxidation is subjected to secondary electrolysis in a solution of a lead salt such as lead acetate by using alternating current thereby depositing lead to the micropores of the oxide film. In this method, since sulfuric acid and the like used as the electrolyte in the preceeding primary anodic oxidation remain in the micropores in the state of active sulfate or sulfide radicals, the active sulfur and the deposite sulfur are reacted with each other to form a lead compound mainly composed of lead sulfide in the micropores. In the alternating immersion process, a metal material applied with an anodic oxide film is alternately immersed to a solution of sulfide such as of ammonium sulfide. In this process, since the lead compound and sulfide are reacted with each other in the active micropores, a lead compound is formed in the micropores of the oxide film. The lead compound may also be formed to the micropores of the oxide film by other means, for example, the lead compound may be formed by merely immersing a metal material applied with the anodic oxide film to a solution of a lead salt and utilizing the reaction between the residual sulfur and lead acetate in the active micropores.

In another embodiment according to this invention, an inorganic metal compound is formed at least to a portion of micropores resulted in the oxide film of anodic oxide metal material.

The inorganic metal compound to be formed in the micropores of the oxide film for improving the characteristics of the metal material can include, for example, metal hydroxides, oxides, sulfides or the likes. Iron hydroxides can be exemplified as the metal hydroxides. Molybdenum oxide, lead oxide and boron oxide can be exemplified as the oxides (although boron is generally considered as non-metal, it has a nature as metal, for example, with respect to its electrical semiconductivity and can be used in practicing this invention. That is, the term "metal" used in this specification also includes those elements having such metalloid properties).

A hydroxide of metal may be formed in micropores by depositing metal hydroxide through the hydrolysis of a complex metal salt or the like. Referring for example to iron, iron (III) ammonium oxalate is hydrolyzed and iron hydroxides deposited thereby (assumed to actually have complicate chemical structures as iron oxides or the hydrates thereof) can be formed in the micropores of the oxide film. Further, molybdenum oxide as an example of the oxides may be formed in the same manner to the micropores by hydrolyzing a 0.1% aqueous solution of ammonium paramolybdate $(NH_4)_2MoO_4.7H_2O$.

Further, boron oxide can be formed in the same manner by the hydrolysis of an aqueous solution of various ammonium borates.

Lead oxide can be formed in the micropores by forming lead sulfide therein, for example, by means of the secondary electrolysis or alternating immersion process and then converting the lead sulfide into lead oxide, for example, by heating.

Molybdenum disulfide as an example of the sulfides can be formed by the hydrolysis or anodic secondary electrolysis of ammonium tetrathiomolybdate $(NH_4)_2MoS_4$ and tungsten disulfide can be formed by the hydrolysis or anodic secondary electrolysis of an aqueous solution of ammonium tetrathio-tungstenate, respectively in the micropores.

In a further embodiment according to this invention, a phosphor compound is formed at least to a portion of micropores resulted in the oxide film of an anodic oxide metal material. Phosphor oxides or compounds of phosphor and metals can be exemplified as the phosphor compound. The phosphor oxide can be formed in the micropores of the anodic oxide film, for example, by the secondary electrolysis. In the secondary electrolysis process, the metal material applied with an oxide film by the primary anodic oxidation is further subjected to the secondary electrolysis using the material as the anode in a solution containing various salts of phosphoric acid as the electrolyte. Then, various phosphate ions forming anions in the electrolyte are attracted to the surface of the metal material and various phosphate radicals discharge mainly in the active micropores of the oxide film to form phosphor oxide, by which the phosphor oxide is impregnated into the micropores. Various kinds of phosphor oxides may be formed depending on the type of the phosphor compounds or processing conditions employed and all of them can be used in this invention.

Further, an intermetallic phosphor compound can be formed in the micropores of an anodic oxide film, for example, by the use of an electroless plating process. In this case, a metal material applied with an anodic oxide film is plated by using a non-electroless metal plating solution containing phosphor. Then, deposited metal platings are in the form of a metal compound incorporated with phosphor, which are formed in the micropores of the anodic oxide film.

In addition, the micropores may also be filled or sealed with lead compounds, inorganic metal compounds or phosphor compounds respectively in any other adequate means.

In accordance with this invention, the lead compound, inorganic metal compound or phosphor compound increases the elasticity and moderates the resonance of a metal material, thereby serving to prevent the occurrence of peaks at a higher frequency region, extend the range of reproducing frequency band and improve the inherent sounds due to the improvement in the sharpness of resonance or internal loss of the metal material.

Moreover, in this invention, a uniform structure can be obtained with no scattering as in the case of vapor deposition or ion beams due to the installing direction of a gun, with neither the reduction of the sensitivity nor particular change in the weight. In addition, such advantages can be attained by a simple technic and at a reduced cost.

The diaphragam obtained in accordance with this invention may be used with no particular restriction in various applications, for example, various types of loud speakers in the configuration, for example, of flat plate, circular disc, cone, dome, etc.

Although lead has a merit of large internal loss, it is not suitable and cannot scarcely be used for diaphragm because of its extremely large density and weak strength and, accordingly, lead has not been used neither as metal lead by itself nor for the treatment mainly composed of a lead compound. However, according to this invention, the foregoing advantageous effects can be attained by the combined use of a lead compound with a metal material in the structure as described above.

The acoustic physical properties of elemental phosphor are at a level nearly twice as that of aluminum as shown in Table 1. However, elemental phosphor is extremely instable as is well-known and difficult to handle with as such and cannot be deposited solely on the metal material. Accordingly, it has been considered impossible so far to apply phosphor to the acoustic materials of this type and no attention has been paid at all.

However, in accordance with this invention, satisfactory results can be attained by the combined use of a phosphor compound with metal material in the structure as described above.

TABLE 1

| | Physical property | | | |
|---|---|---|---|---|
| Material | Density $kg/m^3$ | Elasticity modulus $N/m^2$ | Specific elasticity modulus $m^2/sec^2$ | Sonic velocity m/sec |
| aluminum | 2690 | $7.4 \times 10^{10}$ | $2.7 \times 10^7$ | 5244 |
| phosphor | 1830 | $1.5 \times 10^{11}$ | $8.2 \times 10^7$ | 9045 |

EXAMPLE

Several examples of this invention will now be described. It should however be noted that this invention is no way limited to the following examples.

TEST EXAMPLE 1

In this example, aluminum was used as the metal material. Particularly, aluminum in the shape of a foil was used as a skin material in a honeycomb structure. Further, lead sulfide was formed in the micropores of the oxide film, which was formed in an alternating immersion process in this example.

This example is to be described more specifically.

In this example, an aluminum foil (several μm-several tens μm) was at first anodically oxidized to form anodic oxide film thereon. As the conditions for the anodic oxidation, 15 Wt % sulfuric acid was used and a direct current of 1 $A/dm^2$ was supplied at 25° C. for 18 minutes for the treatment. The anodic oxide film thus obtained was an α-mono-hydrate ($Al_2O_3.H_2O$) film having a film thickness of about 6 μm and the size for the micropores of about 200 Å.

The aluminum applied with the anodic oxide film as described above was treated with the alternating immersion process to be impregnated with lead sulfide. At first, the anodic oxide aluminum was immersed in a 15 wt % aqueous solution of lead acetate (pH 5.3) at 35° C. for 10 seconds, followed by washing with water. Then, it was immersed in a 6 wt % aqueous solution of ammonium sulfide (pH 10.8) at 25° C. for 10 seconds. The above treatments were repeated alternately for three times. It is considered that the following reaction occur in the micropores of the oxide film to form lead sulfide in the micropores.

$$Pb(CH_3COO)_2+(NH_4)_2S \rightarrow PbS+2CH_3COOH+2NH_3$$

The thus obtained film exhibited a golden color and the formation of lead sulfide was confirmed also from the result of X-ray diffraction. Accordingly, the cross section of the material obtained in this example is considered to be as shown in FIG. 1. That is, it is estimated that aluminum 1 has anodic oxide films (alumite layer) 2 formed on the both surfaces thereof and a portion of the oxide film 2 forms a portion incorporated with lead sulfide in the micropores thereof (PbS-containing oxide layer) 3. Since it is considered that the lead sulfide is formed starting from the outerside of the micropores in the immersion process as this example, FIG. 1 shows such a mode. However, if the micropores are completely filled to the inside thereof, the entire oxide film 2 is formed into the PbS-containing oxide layer 3. It is of course possible, depending on the condition, to prepare and use the material of such a structure.

The specimen obtained in this example has a total thickness t of about 23 μm, and each thickness t' of the oxide film 2 of about 6 μm.

Physical properties of the diaphragm prepared by a three-layered composite material obtained in this example are shown in Table 2.

TABLE 2

| Material | Physical property | | | |
|---|---|---|---|---|
| | Density kg/m$^3$ | Elasticity N/m$^2$ | Sonic velocity m/sec | Resonance sharpness |
| Aluminum | 2690 | $7.4 \times 10^{10}$ | 5244 | 250 |
| $Al_2O_3$ | 3960 | $4.3 \times 10^{11}$ | 10420 | 200 |
| Test Example 1 3-layered composite material (specimen of this example) | 2673 | $9.0 \times 10^{10}$ | 5842 | 53 |
| Test Example 4 | 2710 | $9.0 \times 10^{10}$ | 5763 | 80 |
| Test Example 6 | 2425 | $8.8 \times 10^{10}$ | 9045 | 60 |
| Test Example 7 | 3140 | $9.5 \times 10^{10}$ | 5500 | 55 |

As apparent from Table 2 above, the sharpness of resonance is remarkably reduced in this example as compared with that in aluminum or alumina, by which the problem of the internal loss in aluminum or anodic oxide film can be solved and the occurrence of peaks at higher frequency region can be suppressed. Further, the modulus of elasticity is somewhat increased as compared with that in aluminum and, as a result, the bending rigidity is increased and the high frequency critical point can be made higher, by which it is expected that the range of the reproducing frequency band, particularly, the range at the higher frequency band thereof can be extended. Although the modulus of elasticity is further increased since the data for alumina are shown for alumina itself, it is considered that there is less contribution to anodic oxide aluminum. Furthermore, in the specimen of this example, there is no substantial change in the density and thus in the weight as compared with those in aluminum. The density is reduced, although little, by which the contribution to the improvement in the sensitivity can be expected.

In this way, a diaphragm of a satisfactory balance that cannot be obtained by aluminum itself or anodic oxide film thereof can be attained in this example.

TEST EXAMPLE 2

A secondary electrolysis process was used in this example.

An aluminum foil applied with the primary anodic oxidation in the same manner as in Test Example 1 was used, which was applied with an alternating secondary electrolysis in an aqueous 0.1 wt % solution of lead acetate at a bath temperature of 25° C. An alternating current was used here for depositing lead ionized to cations in the solution at the instance where the anodic oxide film is at the cathode phase (if the secondary electrolysis is continued by a direct current using the anodic oxide film as a cathode, the reaction may possibly be hindered by the evolved hydrogen or the like, or the anodic oxide film may possibly be peeled off). The electrolytically deposited lead forms a lead compound mainly composed of lead sulfide in the active micropores. Since sulfate or sulfide radicals having been used during the primary anodic oxidation remain active in the micropores, lead is combined with the active sulfur to form lead sulfide. It is considered in this example that lead sulfide is formed starting from the inner side of the micropores, contrary to Test Example 1.

The same effects as those in Test Example 1 can also be obtained in this example.

TEST EXAMPLE 3

In this example, an aluminum foil applied with the primary anodic oxidation as in Test Example 1 was used, which was immersed in an aqueous solution of lead acetate (25 g/liter) at 60°–70° C. for 30 minutes. As described in Example 2, since active sulfate or sulfide radicals remain in the micropores of the oxide film, they react with lead in the lead acetate to form lead sulfide.

Also in this example, the similar specimen to that in each of the foregoing examples could be obtained. However, it was necessary in this example to use lead sulfide at somewhat higher concentration and a somewhat longer immersion time.

TEST EXAMPLE 4

In this example, iron hydroxide (assumed to have a structure of iron oxides or the hydrates thereof) was formed in the micropores of the oxide film by means of an immersion process.

An aluminum foil applied with the primary anodic oxidation in the same manner as in Test Example 1 was used. Iron (III) ammonium oxalate $(NH_4)_3Fe(C_2O_4).3H_2O$ was added and hydrolyzed to deposit hydroxides on the aluminum foil. Specifically, iron (III) ammonium oxalate was previously dissolved into a 0.3 wt % aqueous solution and heated to 80° C., in which the anodic oxide aluminum foil was immersed for more than 30 seconds in this example.

Thus, iron hydroxide was formed in the micropores of the anodic oxide film. It is considered that iron hydroxide is mainly in the form of $Fe(OH)_3$ which is formed by the hydrolysis through the following reaction. It is considered that since the micropores are active, the hydrolysis is taken place particularly rapidly therein to form iron hydroxide in the micropores.

$$(NH_4)_3.Fe(C_2O_4)_3.3H_2O \rightarrow Fe(C_2O_4)_3 + 3NH_4 + 3\text{-}H_2O$$

$$Fe(C_2O_4)_3 + 6H_2O \rightarrow Fe(OH)_3 + 3(COOH)_2 + 3OH^-$$

Figure 2:
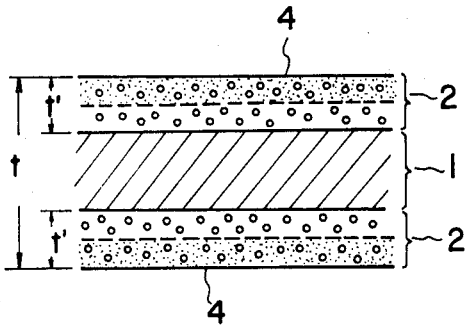
FIG. 2 is a cross sectional side elevational view showing another embodiment of this invention.

It is considered that the cross section of the material obtained in this example is as shown in FIG. 2. Specifically, aluminum 1 has anodic oxide films (alumite layers) 2 formed on both surfaces thereof and a portion of the oxide film 2 is formed into a portion where iron hydroxide is incorporated into the micropores (iron hydroxide-containing oxide film layer) 4. Since it is considered that iron hydroxide is formed starting from the outer side of the micropores in this example, FIG. 2 shows such a state. However, if the micropores are completely filled to the inside, the entire oxide film 2 forms the iron hydroxide-containing oxide layer 4. It is of course possible to prepare and use the material of such a structure depending on the conditions.

The same effects as those in Test Example 1 can also be obtained by this example.

Physical properties of the diaphragm prepared from the specimen obtained in this example are shown in Table 2.

TEST EXAMPLE 5

In this example, lead sulfide was at first formed which was then heated into lead oxide.

Aluminum applied with an anodic oxide film in the same manner as in Test Example 1 was applied with an alternating immersion process to be impregnated with lead sulfide. In this example, an aqueous 6 wt % solution of ammonium sulfide (pH 10.8) at 30° C. was used. The lead sulfide was converted into lead oxide under a heat treatment to form lead oxide in the micropores.

Although lead sulfide was obtained by the alternating immersion process, the secondary electrolytic process may be used as in Test Example 2 and lead sulfide may also be obtained in the same manner as in Test Example 3. Similar specimens to those in each of the foregoing examples were obtained also in this example.

TEST EXAMPLE 6

In this example, phosphor oxide was formed in the micropores of the oxide film by the secondary electrolytic process.

An aluminum foil applied with the primary anodic oxidation in the same manner as in Test Example 1 was used which was treated by the secondary electrolytic process to be impregnated with phosphor oxide.

Specifically, the aluminum applied with the anodic oxide film was subjected to the secondary electrolytic process in an aqueous 0.1 wt % solution of ammonium phosphate, using the anodic oxide aluminum as the anode and supplying a DC current at 50 mA/dm$^2$ for 5 minutes. Since ammonium phosphate is ionized in the aqueous solution as shown by the following formula, the phosphate ions ($PO_4^{3-}$) are attracted toward the aluminum as the anode and, as the result, phosphor oxide is formed in the micropores.

$$(NH_4)_3PO_4 \rightarrow PO_4^{3-} + 3NH_4+$$

Under the above-specified condition, the thickness of the oxide film impregnated with the phosphor compound is of about 3–4 μm and it is considered that the resulted phosphor oxide remains in the form of $PO_4$.

Figure 3:
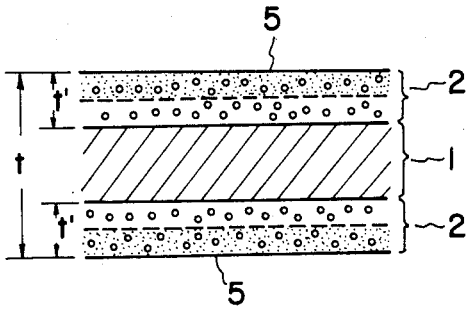
FIG. 3 is a cross sectional side elevational view showing a diaphragm according to a further embodiment of this invention.

It is considered that the cross section of the material obtained in this example is as shown in FIG. 3. Specifically, aluminum 1 has anodic oxide films or alumite films 2 formed on both surfaces thereof and a portion of the oxide film 2 forms a portion where the phosphor oxide is formed in the micropores thereof (phosphor oxide-containing oxide film layer) 5.

Physical properties of the diaphragm prepared by using the thus obtained specimen are shown in Table 2.

The same effects as those in Test Example 1 can be obtained also in this example.

TEST EXAMPLE 7

In this example, a phosphor intermetallic compound was formed in the micropores using an electroless plating process.

Aluminum applied with primary anodic oxidation in the same manner as in Example 1 was used and applied with Ni-P type electroless plating. Blueshumer (trade name of products manufactured by Canizen Co.) was used, for example, as the Ni-P type electroless plating solution and plating was carried out at a bath temperature of 90°–95° C. for 10 minutes. The phosphor content in the electroless plating solution is usually about 10%. A nickel-phosphor compound is formed through the treatment in the micropores of the aluminum oxide film. In this case, the plating thickness obtained was from 4 to 5 μm. The physical properties of the diaphragm obtained by using the specimen in this example are as shown in Table 2.

Also in this example, the internal loss is increased and the sharpness of resonance can remarkably be decreased. The modulus of elasticity is substantially the same as that of aluminum and the specimen can be served well for practical use although somewhat inferior to the specimen of Example 1.

In addition, all of metals capable of electroless plating can be applied by the incorporation of phosphor, not being restricted to the electroless plating of nickel.

As apparent from the foregoings, according to this invention, the elasticity can be increased and the resonance can be moderated in aluminum, by which the peaks at the high frequency band can be suppressed and the range for reproducing frequency band can be extended. Furthermore, with respect to sound quality, colorations inherent to aluminum can also be removed. Specifically, the sharpness of resonance is remarkably reduced in the specimen of this example as compared with that in aluminum or alumina, by which the problem of the internal loss in the aluminum of the anodic oxide film thereof can be overcome and the occurrence of the peaks at the high frequency region can be suppressed. Further, the elasticity is somewhat increased as compared with that in aluminum and, as a result, the bending rigidity is increased and the boundary frequency can be made higher, by which the range of the reproducing frequency band, particularly, the range at a higher region thereof can be extended. Although the modulus of elasticity is further increased since the data for alumina are shown for alumina itself, it is considered that there is less contribution to anodic oxide aluminum. Furthermore, in the specimen of this example, there is no substantial change in the density and thus in the weight compared with those in aluminum. The density is reduced, although little, by which the contribution to the improvement in the sensitivity can be expected.

In this way, a diaphragm of a satisfactory balance that cannot be obtained by aluminum itself or anodic oxide film thereof can be attained in this example.

It will be apparent that this invention is no way limited to the example as described above.

What is claimed is:

1. An acoustical diaphragm comprising a base metal applied with anodic oxide films having micropores, in which a compound chosen from the group consisting of lead compounds, inorganic metal compounds and phosphor compounds is impregnated in at least a portion of the micropores of the anodic oxide film, to obtain an increase in the sonic velocity of the diaphragm to more than 5500 m/sec and a decrease in the sharpness of resonance of the diaphragm to less than 80.

2. A acoustical diaphragm comprising a base metal applied with anodic oxide films having micropores, in which a lead compound is impregnated in at least a portion of the micropores of the anodic oxide film, to obtain an increase in the sonic velocity of the diaphragm to more than 5500 m/sec and a decrease in the sharpness of resonance of the diaphragm to less than 80.

3. An acoustical diaphragm comprising a base metal applied with anodic oxide films having micropores, in which an organic metal compound is impregnated in at least a portion of the micropores of the anodic oxide films, to obtain an increase in the sonic velocity of the diaphragm to more than 5500 m/sec and a decrease in the sharpness of resonance of the diaphragm to less than 80.

4. A diaphragm comprising a base metal applied with anodic oxide films having micropores, in which a phosphor compound is impregnated in at least a portion of the micropores of the anodic oxide film.

5. The diaphragm as defined in any one of claims to 4, wherein the metal material is aluminum.

6. The diaphragm as defined in claim 2, wherein the lead compound is lead sulfide.

7. The diaphragm as defined in claim 3, wherein the inorganic metal compound is selected from hydroxide, oxide and sulfide of metals.

8. The diaphragm as defined in claim 7, wherein the hydroxide of the metals is iron hydroxide.

9. The diaphragm as defined in claim 7, wherein the hydroxide of the metals is lead hydroxide.

10. The diaphragm as defined in claim 4, wherein the phosphor compound is phosphor oxide.

* * * * *